US008485868B2

(12) United States Patent
Weder

(10) Patent No.: US 8,485,868 B2
(45) Date of Patent: Jul. 16, 2013

(54) FLOOR TREATMENT APPARATUS WITH SOLITARY DRIVE PULLEY

(75) Inventor: James Weder, Sedona, AZ (US)

(73) Assignee: Design Technologies LLC, Bellevue, WA (US)

( * ) Notice: Subject to any disclaimer, the term of this patent is extended or adjusted under 35 U.S.C. 154(b) by 882 days.

(21) Appl. No.: 12/632,130

(22) Filed: Dec. 7, 2009

(65) Prior Publication Data

US 2011/0136417 A1 Jun. 9, 2011

(51) Int. Cl.
*B24B 23/02* (2006.01)

(52) U.S. Cl.
USPC ..... 451/353; 15/52; 451/350; 474/87

(58) Field of Classification Search
USPC ..... 451/350, 351, 352, 353; 474/87; 15/49.1, 15/52, 98
See application file for complete search history.

(56) References Cited

U.S. PATENT DOCUMENTS 7,226,347 B1 * 6/2007 Padgett et al. ..... 451/353
7,326,106 B1 * 2/2008 Rogers et al. ..... 451/350
7,458,883 B2 * 12/2008 Wilson et al. ..... 451/353

* cited by examiner

*Primary Examiner* — Timothy V Eley
(74) *Attorney, Agent, or Firm* — Young & Thompson

(57) ABSTRACT

A floor treatment apparatus includes a frame, a housing which is rotatable with respect to the frame according to a main axis, at least three head pulleys which are rotatable with respect to the housing according to respective head axes which are regularly spaced around, and which are parallel to, the main axis, a motor supported by the frame and a main belt drivable by the motor and being slung around the drive pulley and the driven head pulleys. Furthermore, the main belt is slung around a first auxiliary pulley and a second auxiliary pulley. The second auxiliary pulley is driven by the first auxiliary pulley. An auxiliary belt is slung around a fixed pulley connected to the frame and around the second auxiliary pulley for rotating the housing with respect to the frame.

18 Claims, 4 Drawing Sheets

FLOOR TREATMENT APPARATUS WITH SOLITARY DRIVE PULLEY

BACKGROUND OF THE INVENTION

1. Field of the Invention

The invention is related to the field of apparatus for treating floors of stone or stone like material.

2. Description of the Related Art

Such apparatus are well known per se, and are applied for several kinds of treatments. For instance, by means of an apparatus equipped with suitable grinding discs, the process of grinding of floors for the purpose of smoothening new or worn out floors can be carried out. Also, such apparatuses can be used for daily maintenance of heavily used stone floors, such as the floors in public areas, in retail buildings and the like.

The heads of the apparatus may thus be provided with several types of grinding discs or maintenance pads and the like. The heads are usually driven by means of an electric motor which is supported on the frame of the apparatus. At the same time, the housing of the apparatus is slowly driven in rotation as well so as to stabilize the behavior of the apparatus and to simplify handling thereof by the operator. The housing rotation is usually obtained from the same electric motor which drives the heads.

Several proposals have been made for enabling the single electric motor to drive both the heads as well as the housing at the required rotational speeds. As mentioned, the housing is rotated at a lower speed than the heads. This entails different drives for the heads on the one hand, and the housing on the other hand. Examples of such apparatuses are given in U.S. Pat. No. 6,783,447, U.S. Pat. No. 7,241,210, EP-A-1,915,232, WO-A-94/08752 and WO-A-02/062524.

BRIEF SUMMARY OF THE INVENTION

The object of the invention is to provide an apparatus of the type before which has a simple and reliable construction. This object is attained by means of a floor treatment apparatus, comprising a frame, a housing which is rotatable with respect to the frame according to a main axis, at least three head pulleys which are rotatably connected to the housing according to respective head axes which are regularly spaced around, and which are parallel to, the main axis, a motor supported by the frame, a main belt drive comprising a drive pulley which is drivable by the motor, respective driven head pulleys, and a main belt which is slung around the drive pulley and the driven head pulleys, as well as an auxiliary belt drive for rotating the housing with respect to the frame, wherein the auxiliary belt drive comprises a first auxiliary pulley around which the main belt is slung, a second auxiliary pulley drivable by the first auxiliary pulley, a fixed pulley connected to the frame and an auxiliary belt slung around the second auxiliary pulley and the fixed pulley.

In the floor treatment apparatus according to the invention, the power for driving the housing in rotation is taken from the main belt through the first auxiliary pulley around which the main belt is slung. Thus, the auxiliary drive for rotating the housing is directly derived from said main belt. Depending inter alia on the ratio of the diameter of the head pulleys on the one hand, and the first auxiliary pulley on the other hand, the desired ratio of the rotational speeds of the heads and of the housing can be influenced. According to a further advantage, the head pulleys are now all exposed to similar conditions which only result from the grinding or polishing action and the like.

Moreover, no additional height is necessary for accommodating said first auxiliary pulley as it is positioned at the same level as the other pulleys and main belt of the main drive. In particular, this advantage is clear from the embodiment according to which the housing comprises a base plate and the drive pulley, the head pulleys as well as the first auxiliary pulley are positioned on one and the same side or main side of said base plate.

The building height of the base plate including the pulleys mounted thereon is relatively small. Furthermore, the second auxiliary pulley and the fixed pulley are positioned on top of or above the housing.

According to a preferred embodiment, the main belt is slung around the drive pulley, the head pulleys and the first auxiliary pulley in such a way that they are in contact with one and the same side of said main belt and said pulleys are drivable in the same rotational sense. Also, the auxiliary belt can slung around the second auxiliary pulley and the fixed pulley in such a way that they are on the same side of the auxiliary belt. Thereby, the head pulleys will rotate in counter direction to the housing, which is favourable for the motion behavior of the apparatus.

The rotational speed ratio of the head pulleys and of the housing depends inter alia on the diameter of said pulleys, as mentioned before. In case differences in diameter are sufficient for obtaining the desired speed ratio, the second auxiliary pulley can be coaxially connected to the first auxiliary pulley.

However, it is also possible to increase said ratio by applying an intermediate transmission between the first and the second auxiliary pulley. This intermediate transmission could be obtained by inter engaging tooth wheels of different diameters, however preference is given to an embodiment wherein the second auxiliary pulley is connected to the first auxiliary pulley through an intermediate belt as well as first and second intermediate pulleys which are coaxially connected to respectively the first auxiliary pulley and the second auxiliary pulley.

This is in particular attractive in the embodiment wherein the shafts of the head pulleys as well as the head pulleys themselves extend upwardly from the base plate only over a distance smaller than the height of the housing. Thus, the space within the housing above said pulleys remains free of shafts whereby it becomes possible to install the intermediate belt and pulleys within said housing without impeding the orbiting motion thereof around the central axis.

BRIEF DESCRIPTION OF THE DRAWINGS

The invention will now be described further with reference to an embodiment shown in the drawings.

DETAILED DESCRIPTION OF THE PREFERRED EMBODIMENTS

Figure 1:
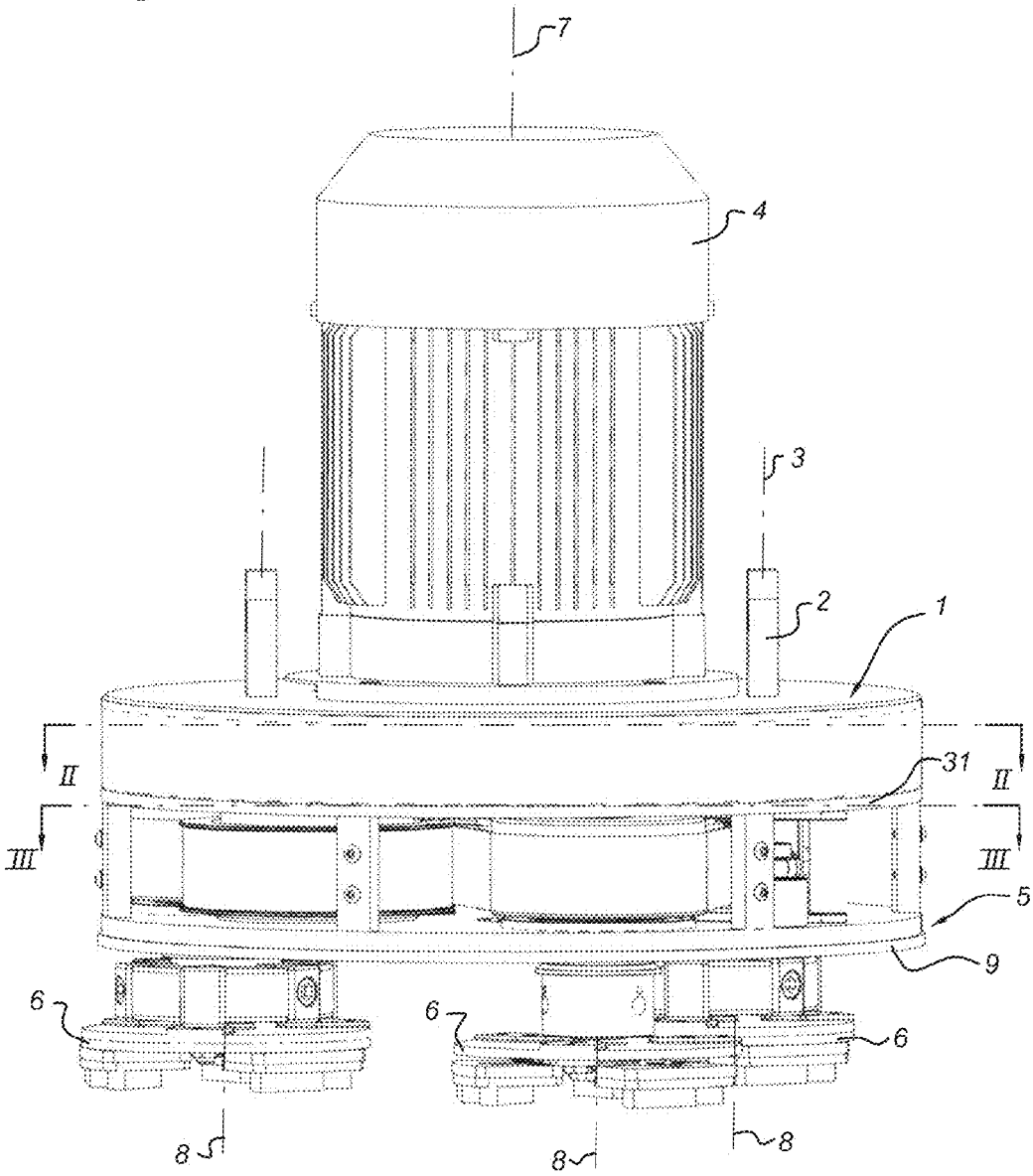
FIG. 1 shows a side view of the floor treating apparatus.

The floor treating machine as shown in the side view of FIG. 1 comprises a frame 1 having lugs 2 onto which handlebars 3 are mounted. By means of these handlebars 3, the operator can direct the floor treating machine in any desired direction over a floor surface to be treated. An electric motor 4 is supported on the frame 1. Furthermore, a housing 5 is connected to the frame 1 in such a way that it is rotatable about a central axis 7 which coincides with the axis of the electric motor 4. For reasons of clarity, part of the side wall of the housing has been omitted. Three heads 6 are in turn rotatably supported with respect to the housing 5; their axes of rotation 8 are regularly arranged around the central axis 7 and are parallel to said central axis.

Figure 3:
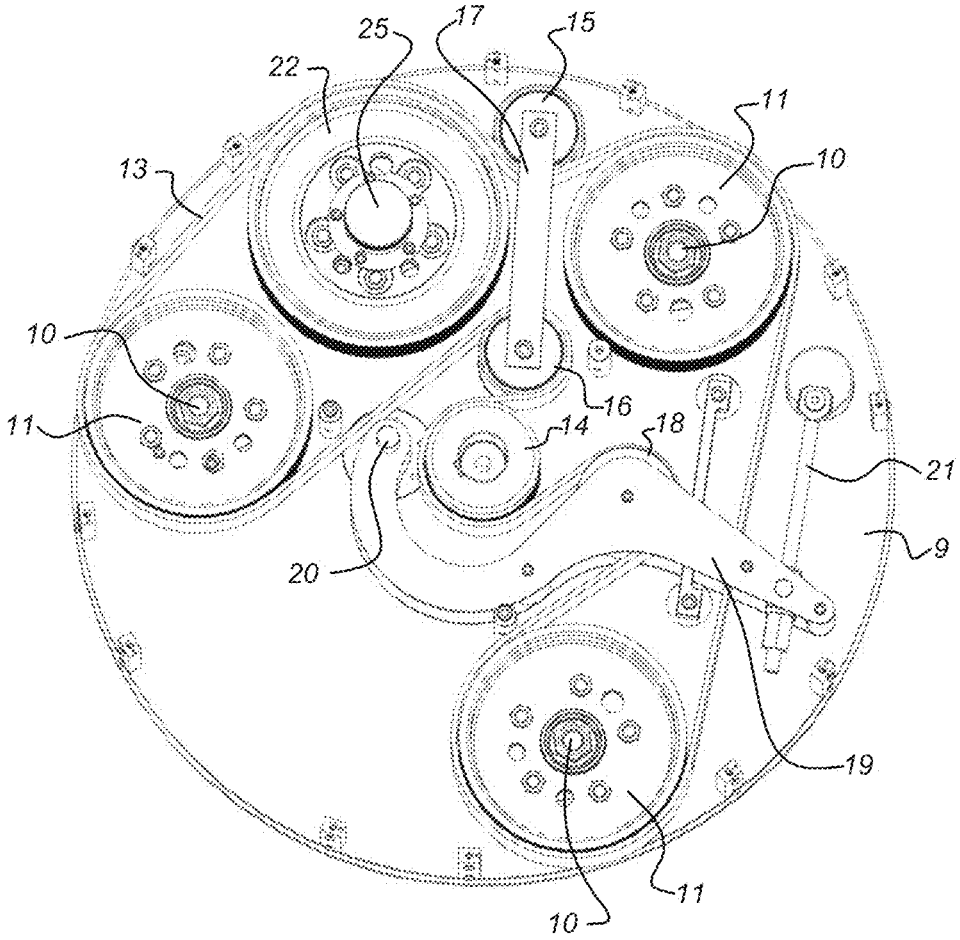
FIG. 3 shows an open view in perspective of the housing without top plate, according to III-III of FIG. 1.

As shown in FIG. 3, the housing 5 has a base plate 9 below, which base plate 9 is equipped with three shafts 10, regularly spaced around the central axis 7 and rotatably supported with respect to the base plate 9 by means of suitable bearings (not visible). On to each shaft 10 and above the base plate 9, a head pulley 11 is connected together with a respective head 6 below the base plate 9, in such a way that a torque can be transferred from the head pulley 11 to the respective head 6 and the polishing or grinding pad mounted thereon. Around the head pulleys 11, the main belt 13 has been slung. Furthermore, the main belt 13 is slung around the drive pulley 14 which is fixedly connected to the motor shaft of the electric motor 4. Said motor shaft, which is not visible in the figures, is freely rotatable with respect to the frame 1 as well as with respect to the housing 5. Additionally, idle tensioning pulleys 15 and 16 are connected to each other by means of a brace 17 for tensioning the main belt 13. A further tensioning pulley 18 is rotatably connected to the tensioning arms 19 which at one and are rotatably connected to the base plate 9 at pivot 20 and which at the other end are biased by means of the biasing means 21.

Figure 2:
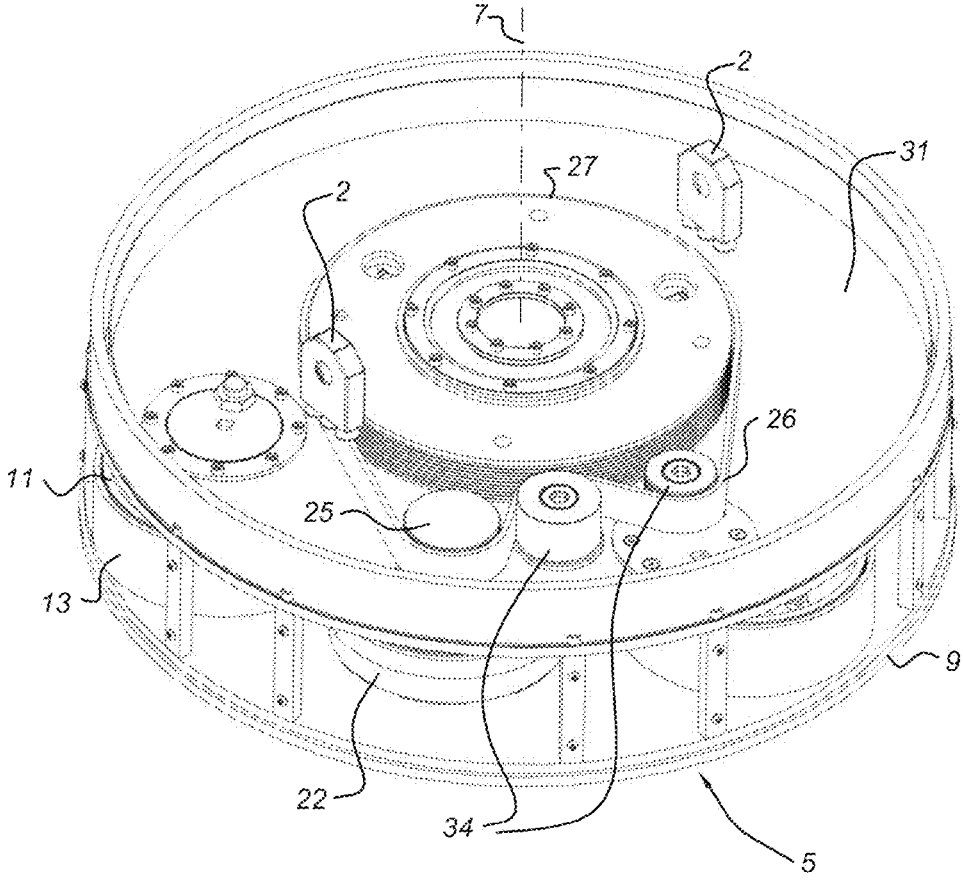
FIG. 2 shows an open view in perspective of the housing including top plate, according to II-II of FIG. 1.

According to the first embodiment of FIGS. 1-3, a first auxiliary pulley 22 (positioned below the top plate 31) is directly and fixedly connected to a shaft (not shown) which extends upwardly through the top plate 31 of the housing 5 and which is fixedly connected to the second auxiliary pulley 25 above the top plate 31. Around this second auxiliary pulley 25, an auxiliary belt 26 has been slung. This auxiliary belt 26 is furthermore slung around the pulley 27 which is non-rotatable connected to the frame. Additionally, the auxiliary belt 26 is slung around the idle pulleys 34. One of said idle pulleys 34 can be used for tensioning the auxiliary belt 16. The surfaces of the second auxiliary pulley 25, the fixed pulley 27 and the surface of the auxiliary belt 26 which contact said pulleys is grooved in the running direction for providing an increased traction.

Figure 4:
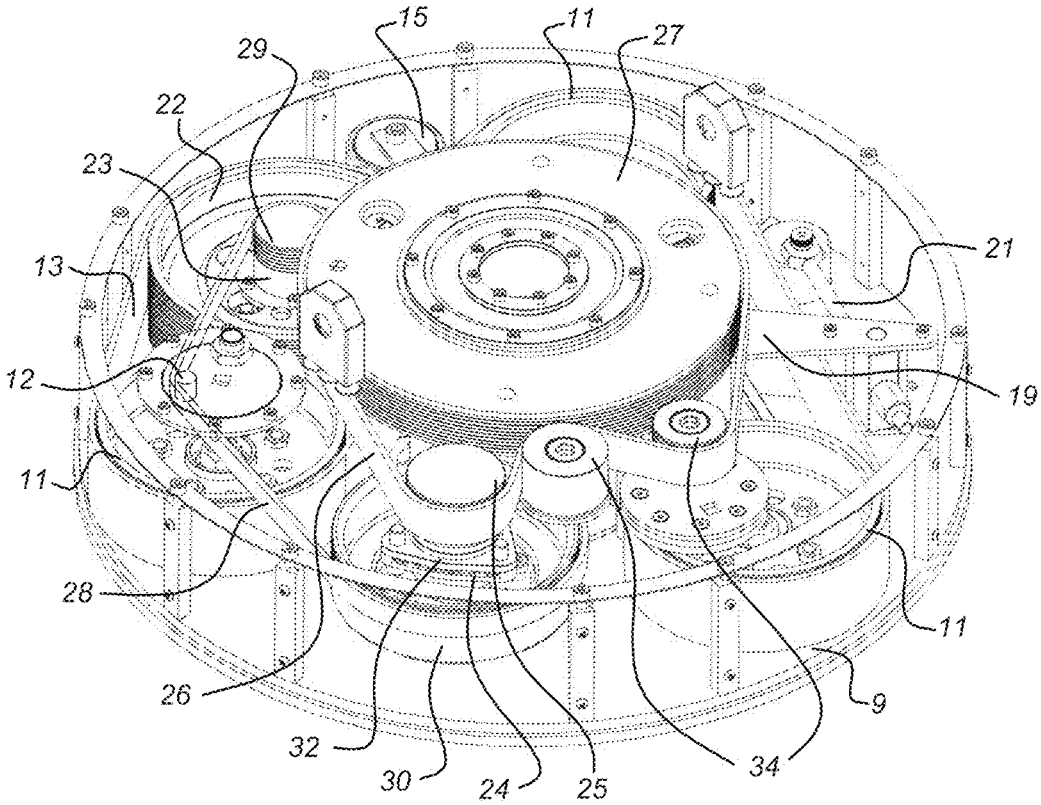
FIG. 4 shows an open view in perspective of a second embodiment of the apparatus.

It is pointed out that the shafts 10 and the corresponding head pulleys 11 extend only over part of the height within the housing. Thus, the space above theses components is open in such a way that a further transmission can be incorporated therein. This advantage has been used in the second embodiment of FIG. 4. As shown, the first auxiliary pulley 22 is fixedly connected to a first intermediate pulley 29, in such a way that a torque can be transmitted between these pulleys. Furthermore, a shaft 32 is rotatably suspended through the top plate (not shown in FIG. 4) of the housing by means of rolling element bearing 24.

This shaft 32 is connected on the one hand to a second intermediate pulley 30, within the housing 5, and the second auxiliary pulley 25 above the housing In such a way that a torque can be transmitted between these pulleys. An intermediate belt 28 is slung around the first and second intermediate pulleys 29, 30, as well as around an idle pulley 12. Furthermore, an auxiliary belt 26 is slung around the second auxiliary pulley 25 as well as around the fixed pulley 27 which is non-rotatable connected to the frame 1. Tensioning pulleys for tensioning the auxiliary belt 26 may be present as well. The surfaces over the head pulleys 11, drive pulley 14 and first auxiliary pulley 22, as well as the surface of the main belt 13 which contacts said pulleys, are grooved in the running direction for providing an increased traction.

The floor treatment apparatus described before is operated as follows. The operator grasps the handle bars 3, and sets the electric motor 4 in motion. Thereby, the drive pulley 14 is rotated, which makes rotate the head pulleys 11 as well through the action of the main belt 13. Thereby, the floor treatment pads, which are connected to the head pulleys 11, are rotated for exerting the required treatment action on the floor surface. At the same time, the first auxiliary pulley 22 is rotated by the main belt 13 as well (embodiment of FIGS. 1-3) or through the intermediate belt 28 as well as the intermediate pulleys 29, 30 (embodiment of FIG. 4). The second auxiliary pulley 25 is rotated correspondingly, and due to the fact that this second auxiliary pulley 25 engages the static pulley 27 of the frame 1, the housing 5 is rotated around the main shaft 7. As a result of the specific lay out of the main drive for rotating the head pulleys and of the auxiliary drive for rotating the housing, the head pulleys on the one hand and the housing on the other hand rotate in counter direction. Thereby, it is easier to operate the apparatus.

LIST OF REFERENCE NUMERALS

1. Frame
2. Lug of frame
3. Handlebar
4. Electric motor
5. Housing
6. Head
7. Central or main axis
8. Axis of head pulley
9. Base plate housing
10. Shaft
11. Head pulley
12. Idle pulley
13. Main belt
14. Drive pulley
15. Tensioning pulley
16. Tensioning pulley
17. Brace
18. Tensioning pulley
19. Tensioning arm
20. Pivot of tensioning arm
21. Biasing means
22. First auxiliary pulley
23. Shaft
24. Bearing
25. Second auxiliary pulley
26. Auxiliary belt
27. Fixed pulley on frame
28. Intermediate belt
29. First intermediate pulley
30. Second intermediate pulley
31. Top plate housing
32. Shaft
33. Bearing
34. Idle pulley

The invention claimed is:

1. A floor treatment apparatus, comprising:

a frame (1);

a housing (5) which is rotatable with respect to the frame about a main axis (7);

at least three head pulleys (11) which are rotatable with respect to the housing about respective head axes (8) which are regularly spaced around, and which are parallel to, the main axis (7);

a motor (4) supported by the frame;

a main belt (13) drivable by the motor (4) and operationally disposed around a drive pulley (14) and the at least three head pulleys (11);

a first auxiliary pulley (22) around which the main belt (13) is operationally disposed;

a second auxiliary pulley (25) drivable by the first auxiliary pulley (22);

a fixed pulley (27) connected to the frame (1); and an auxiliary belt (26) operationally disposed around the second auxiliary pulley (25) and the fixed pulley (27) for rotating the housing (5) with respect to the frame (1).

2. The floor treatment apparatus according to claim 1, wherein the main belt (13) is operationally disposed around the head pulleys (11) and the first auxiliary pulley (22) in such a way that the head pulleys (11) and the first auxiliary pulley (22) are in contact with a same side of said main belt (13) and said pulleys are drivable in a same rotational sense.

3. The floor treatment apparatus according to claim 2, wherein the auxiliary belt (26) is operationally disposed around the second auxiliary pulley (25) and the fixed pulley (27) in such a way that the second auxiliary pulley (25) and the fixed pulley (27) are on a same side of the auxiliary belt (26).

4. The floor treatment apparatus according to claim 2, wherein the second auxiliary pulley (25) is coaxially connected to the first auxiliary pulley (22).

5. The floor treatment apparatus according to claim 2, wherein the second auxiliary pulley (25) is connected to the first auxiliary pulley (22) through an intermediate belt (28) as well as first (29) and second (30) intermediate pulleys which are coaxially connected to respectively the first auxiliary pulley (22) and the second auxiliary pulley (25).

6. The floor treatment apparatus according to claim 1, wherein the auxiliary belt (26) is operationally disposed around the second auxiliary pulley (25) and the fixed pulley (27) in such a way that are on a same side of the auxiliary belt (26).

7. The floor treatment apparatus according to claim 6, wherein the second auxiliary pulley (25) is coaxially connected to the first auxiliary pulley (22).

8. The floor treatment apparatus according to claim 6, wherein the second auxiliary pulley (25) is connected to the first auxiliary pulley (22) through an intermediate belt (28) as well as first (29) and second (30) intermediate pulleys which are coaxially connected to respectively the first auxiliary pulley (22) and the second auxiliary pulley (25).

9. The floor treatment apparatus according to claim 1, wherein the second auxiliary pulley (25) is coaxially connected to the first auxiliary pulley (22).

10. The floor treatment apparatus according to claim 1, wherein the second auxiliary pulley (25) is connected to the first auxiliary pulley (22) through an intermediate belt (28) as well as first (29) and second (30) intermediate pulleys which are coaxially connected to respectively the first auxiliary pulley (22) and the second auxiliary pulley (25).

11. The floor treatment apparatus according to claim 10, wherein the housing (5) comprises a base plate (9) and the drive pulley (14), the head pulleys (11) as well as the first auxiliary pulley (22) are positioned on the upper side or main side of said base plate (9).

12. The floor treatment apparatus according to claim 11, wherein the drive pulley (14) and the head pulleys (11) are connected to shafts (10) which extend through the base plate (9) and which are rotatably supported with respect to the base plate (9) through bearings, and the shafts (10) of the head pulleys (11) as well as said head pulleys (11) extend upwardly from the base plate (9) over a distance smaller than the height of the housing (5), in such a way that the intermediate belt (28) as well as the first and second intermediate pulleys (29, 30) are positioned above said head pulleys (11).

13. The floor treatment apparatus according to claim 12, wherein the intermediate belt (28) as well as the first and second intermediate pulleys (29, 30) are accommodated within the housing (5).

14. The floor treatment apparatus according to claim 1 wherein the second auxiliary pulley (25) and the fixed pulley (27) are positioned above a top plate (31) of the housing (5).

15. The floor treatment apparatus according to claim 1, wherein the main belt (13) is a grooved belt and the drive pulley (14), the head pulleys (11) and the first auxiliary pulley (22) are grooved in a running direction.

16. The floor treatment apparatus according to claim 1, wherein means for tensioning the main belt (15-21) are provided.

17. The floor treatment apparatus according to claim 1, wherein each of the head pulleys (11) comprise a head (6) with means for fastening a treatment disc or pad thereto.

18. The floor treatment apparatus according to claim 1, wherein the housing (5) comprises a base plate (9) and the drive pulley (14), the head pulleys (11) as well as the first auxiliary pulley (22) are positioned on an upper side or main side of said base plate (9).

* * * * *